United States Patent [19]

Knoche et al.

[11] Patent Number: 4,953,361

[45] Date of Patent: Sep. 4, 1990

[54] PROCESS FOR THE OPERATION OF A GENERATOR ABSORPTION HEAT PUMP HEATING INSTALLATION FOR SPACE HEATING, WATER HEATING, ETC. AND GENERATOR ABSORPTION HEAT PUMP HEATING INSTALLATION

[76] Inventors: Karl F. Knoche, Schinkelstrasse 8, D-5100 Aachen; Dieter Stehmeier, Schlossweiherstr. 14; Heinz-Bernd Grabenhenrich, Lütticher Str. 320, both of 5100 Aachen, all of Fed. Rep. of Germany

[21] Appl. No.: 385,156

[22] Filed: Jul. 26, 1989

Related U.S. Application Data

[63] Continuation of Ser. No. 242,128, Sep. 9, 1988, abandoned, which is a continuation of Ser. No. 130,659, Dec. 4, 1987, abandoned, which is a continuation of Ser. No. 9,668, Feb. 2, 1987, abandoned, which is a continuation of Ser. No. 776,881, Sep. 17, 1985, abandoned.

[51] Int. Cl.[5] ..... F25B 7/00

[52] U.S. Cl. ..... 62/79; 62/238.3

[58] Field of Search ..... 62/79, 288.3

[56] References Cited

U.S. PATENT DOCUMENTS 4,312,476 1/1982 Pohlman ..... 62/238.3 X 4,561,259 12/1985 Van der Sluys ..... 62/238.3 X

*Primary Examiner*—Lloyd L. King

*Attorney, Agent, or Firm*—Antonelli, Terry, Stout & Kraus

[57] ABSTRACT

A heating installation and process for operating a monovalent generator absorption heat pump heating installation for space heating, water heating, ect. up to a calorific power of approximately 20 kW wherein operation takes place with a periodic change of the operating phases generation with condensation and evaporation with absorption at different pressure levels. In the generating phase, high temperature heat is supplied via the generator to a working substance solution circuit and during the condensation of the resulting vapor at the condenser, useful heat is supplied to the heating water. During the absorption phase, low temperature heat is supplied to the coolant in the evaporator and is given off in the absorber to the heating water in the form of useful heat. The high or low temperature heat supplied is alternately switched on when the heating water return or forward temperture drops below a predetermined lower temperature, and switched off when the heating water return or forward temperature exceeds a predetermined upper temperature limit.

24 Claims, 3 Drawing Sheets

PROCESS FOR THE OPERATION OF A GENERATOR ABSORPTION HEAT PUMP HEATING INSTALLATION FOR SPACE HEATING, WATER HEATING, ETC. AND GENERATOR ABSORPTION HEAT PUMP HEATING INSTALLATION

CROSS REFERENCE TO RELATED APPLICATIONS

This application is a continuation of U.S. application Ser. No. 242,128, filed Sept. 9, 1988, now abandoned; which is a continuation of U.S. application Ser. No. 130,659, filed Dec. 4, 1987, now abandoned; which is continuation of U.S. application Ser. No. 009,668, filed Feb. 2, 1987, now abandoned; which a continuation of U.S. application Ser. No. 776,881, filed Sept. 17, 1985, now abandoned.

BACKGROUND OF THE INVENTION

The present invention relates to an installation and process for operating a generator absorption heat pump heating installation such as for example, space heating, water heating, etc. up to a calorific power of approximately 20 kW.

Known continuously operating absorption heat pump heating installations, normally with ammonia/water as the working substance solution, require a solution pump in order to pump the same from the absorber into the generator, optionally via a heat exchanger. Such solution pumps require motive energy, and need maintainance and are in part susceptible to faults.

In small capacity absorption cooling means such as disclosed in, for example, German Patent 842,352, an auxiliary gas is provided to avoid a solution pump; however, this proposal leads to a weak substance exchange and, consequently, requires not only a large apparatus, but considerably large heat exchange surfaces.

Absorption installations proposed in German Patent 427,278, can only be used in conjunction with the coolant water due to the necessary hydrostatic heights and the resulting overall height of the equipment and can consequently only be used for air conditioning purposes.

Absorption heating systems with direct heating of the generator by a generator absorbing high temperature energy make it possible to save primary energy in connection with the heating heat supply of buildings, because part of the necessary heat can be taken from the environment. However, the date two essential points have prevented the wide introduction of such heating installations and these points are interconnected. Firstly and as in heat pumps, the problem exists that the heating heat requirement of the building and the power availability of the heat pump behave in opposite ways with falling external temperatures, so that compared with refrigerating machines, which usually operate in a narrowly defined operating range, the question of partial load control is of particular significance for fuel saving. Secondly, only a very small primary energy saving can be expected on continuously operating absorption heat pumps, which are solely regulated via the ratio of the running time to the idle time, i.e. with conventional on-off controls because a large amount of the annual heating work has to be provided at temperatures above 0° C., which leads to high idle time losses.

Therefore a large number of proposals have been made in, for example, DE-OS 31 49 005 and DE-OS 31 40 003, to so extend the conventional absorption heat pump that a single apparatus can provide both the maximum calorific power at the lowest outside temperature and the lower heat requirement in the partial load range.

However, according to these proposals, relatively complicated installations are required, which require considerable equipments and other components, such as heat exchangers, solenoid valves, connecting lines and controls, so that the additional plant costs for improving the annual heating figure cannot really be compensated. In addition, all known continuously operating absorption heat pump heating systems require a solution pump, which is a fault-prone unit consuming a not inconsiderable amount of operating current.

On the basis of a known proposal according to DE-OS 29 38 203, which can in particular be advantageously realized in conjunction with heat carrier circuits, as a multistage, periodically operating absorption heat pump for heat recovery and ventilation systems, the problem of the invention is to reduce the number of equipments and to make do as far as possible without fault-prone, maintainance-requiring and energy-consuming components or units.

In accordance with the present invention, a process for an operation of a generator absorption heat pump heating installation for space heating, water heating, etc. is provided in which heating energy to be supplied to the heating water to be heated flows back from the heating system and can be supplied by both high temperature heat taken from a directly heated generator and from a low temperature heat absorbed by an absorption heat pump. The absorption heat pump is operated with a periodic change of operating phases including generation with condensation and evaporation with absorption at difference pressure levels. In the generation phase high temperature heat is supplied through the generator to a working substance solution circuit and useful heat during the condensation of the resulting vapor of the condenser is supplied to the heating water. During the absorption phase the temperature heat is supplied to the coolant in an evaporator and as useful heat in the absorber is supplied to the heating water. Both the high and low temperature heat supply is ultimately switched on when the heating water return or supply temperature drops below a predetermined lower temperature limit and is switched off when the hot water return or supply temperature rises above a predetermined upper temperature.

A maximum or almost a maximum calorific power of the heat pump heating installation, in accordance with the present invention, is diverted at low external temperatures by a high temperature heat supply to the generator and from the generator to a working substance solution circuit of the absorption heat pump. The condensate produced in the condenser following the complete filling of the coolant accumulator is returned to the absorber in the absorption heat pump. The working substance solution is then used as a heat carrier between the generator and the condenser through which the heating liquid flows.

To obtain a very high heat absorption on the evaporator and performance figure rise on the generator and absorber operation of the heating installation, a predeterminable minimum running time is maintained.

In accordance with further features of the present invention, a monovalent alternative generator absorption heat pumping installation for space heating, water heating, etc. up to a calorific capacity of approximately 20 kW is provided with the heating installation including a heat pump means having the evaporator means heatable by external heat and through whose heat exchanger flows coolant. An absorber means connected on a cold vapor side to the evaporator includes a heat exchanger means through which heating liquid or water of the heating system flows. A condenser means is connected on a coolant side to the evaporator means and to the absorber means and includes a heat exchanger means through which heating liquid flows. A generator means directly heatable by primary energy includes a heat exchanger constructed as a thermosiphon connected to a working substance solution chamber of the absorber means at a low point and high point so as to permit natural working circulation and to the working substance accumulator means of the condenser means. Stop valve means are respectivley provided in coolant connecting lines between the evaporator and the absorber and between the condenser and the evaporator. The stop valve between the evaporator and the absorber includes a one-way valve for allowing a vapor flow only to the absorber, with the valve between the condenser and the evaporator including a one-way valve for only allowing a liquid flow to the evaporator and for closing when the evaporator is complete filled with coolant so as to permit a flow back into the absorber by a liquid coolant line. The heating liquid can be passed through the heat exchanger of the condenser during high temperature heating supply and through the heat exchanger of the absorber during low temperature heat supply. A switch over of the heating liquid flow can alternately be automatically performed by a changeover valve when the heating liquid return or supply temperature drops below predetermined upper and lower preset temperature limits.

The generator according to the present invention may include a waste gas cooler connected downstream of the condenser on the heating liquid side, and the generator and the absorber may be separated from one another with the absorber being constructed as a working substance solution accumulator.

Advantageously, vapor chambers of the absorber and the generator are connected by a vapor pressure compensating line, with a high outlet means for a rich solution and low outlet means for a weak solution being arranged in such a manner that a natural concentration stratification during a discharge of a solution can be utilized with a minimum reabsorption.

The absorber in accordance with the present invention may be provided with means which, during absorption, returns to a lower part of the absorber sprayed on solution and brings about a forced circulation for preventing stratification of a concentration of a solution. Additionally, at least one of the condenser is provided with a coolant accumulator and the evaporator is constructed as a coolant accumulator.

Furthermore, means are provided for stopping or closing a working substance solution accumulator when the maximum permitted filling does not permit a vapor flow from the evaporator to the condenser so as to bring about an entry of coolant into the absorber through a connecting line between the condenser and the absorber. The closing or stopping means may include, for example, a one-way flow valve.

In installation of the present invention, the working substance solution includes several coolant components having lower boiling fractions which remain in the coolant accumulator as the low temperature heat drops.

Advantageously, in accordance with further features of the present invention, a heat exchanger means may be interposed between the absorber and the generator.

The invention makes it possible to provide the heating energy with minimum equipment and without a solution pump. The disadvantage of periodically operating absorption installations, which consists of large parts of the installation and working substance solutions consisting of solvents and coolants having to be intermittently heated and cooled, through generation and absorption on the one hand, as well as evaporation and condensation on the other being carried out in separate equipments, so that the larger part of the overall installation remains constantly in the range of the useful temperature level and consequently the heat losses can be kept low through installation. The equipment volume and heat exchange surfaces are comparatively small, operation taking place at widely varying pressure levels through a periodic change of operating phase generation and absorption. Unlike the case of continuously operating absorption heat pumps, the operating phases of generation with condensation and evaporation with absorption take place in a time-separated manner.

The high temperature heat produced in the generator produces hot vapor, which is condensed in the condenser by the heating water and consequently supplies its useful heat, e.g. at 50° C. to the heating water. The low temperature heat supplied at a different time to the evaporator leads to the production of cold vapor, which is condensed in the absorber and also at approximately 50° C. gives off its useful heat to the heating water which is now passed through the absorber, after previously reversing the changeover valve.

Compared with periodically operating absorption refrigerating machines, which only provide refrigerating capacity during the evaporation phase, the heating installation according to the invention is usefully employed throughout the entire operating period, because either useful heat is supplied as condensation heat in the condenser or useful heat is supplied to the heating water to be heated in the absorber as absorption heat.

Due to the time separation between generation and absorption, it is possible to achieve an adequate substance exchange without the otherwise necessary solution pump, because the pressure level in the complete installation is raised or lowered (motionless apparatus). The decisive advantage of such a heating installation is consequently that the periodically operating absorption heat pump can be operated without any auxiliary energy, so that it functions in a substantially noiseless and maintainance-free manner.

The condenser, a container below the condenser or the evaporator can be constructed as coolant or refrigerant accumulators, so that all partial load operating points are then made possible with sliding working temperatures with optimum coupling in of heat from the ambient or environment (low temperature heat). As a function of the necessary heating water temperatures the calorific power of the installation is slidingly adapted to the heat requirements via the ratio of generator (burner) operating time to evaporator (absorber) operating time, it being appropriate to adhere to specific minimum running times. This means that slightly below the heating limit (e.g. 15° C.), the maximum degassing scope of the working substance system used is fully utilized, whereas at the lowest design point (e.g. −10°

C.) the installation can pass into purely permanent generator operation (boiler operation), in which the working substance solution merely serves as a heat carrier.

BRIEF DESCRIPTION OF THE DRAWINGS

The invention is described in greater detail hereinafter relative to an embodiment and the attached drawings, wherein.

DETAILED DESCRIPTION

The embodiment describes a generator absorption heat pump for the heating water supply of buildings, with direct heating of the generator with high temperature heat produced by the burner and of the evaporator with low temperature heat taken from the environment and which is e.g. supplied by a fan.

Figure 1:
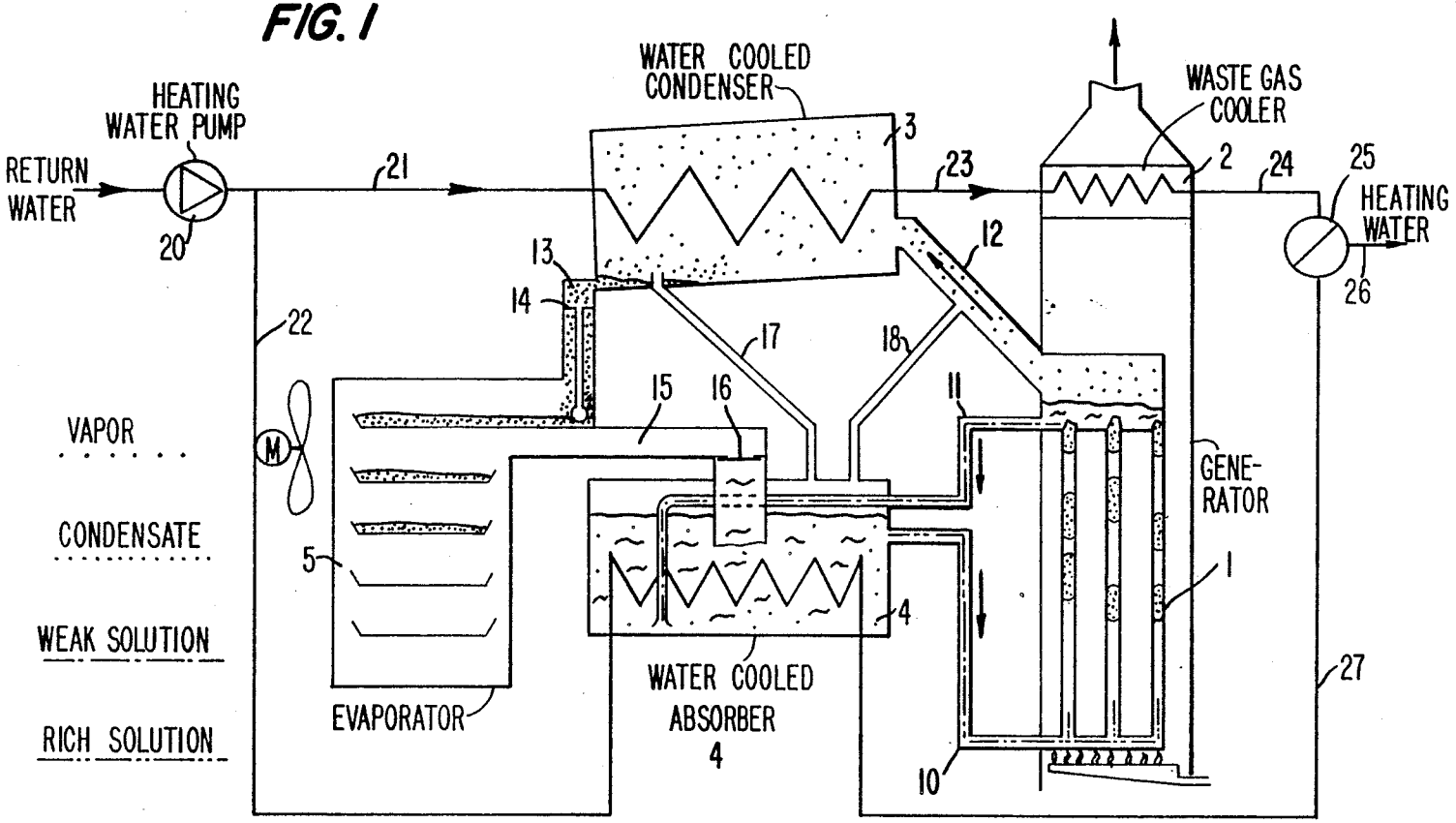
FIG. 1 is a schematic circuit diagram of the periodically operating generator absorption heat pump in the generator operation phase.

The heating installation according to FIG. 1 comprises five main components, namely, a generator 1 directly heated by burners, the waste gas cooler 2 integrated therewith, a heating water-cooled condenser 3, a heating water-cooled absorber 4 and an evaporator 5 with direct coupling of heat from a low temperature heat source namely e.g. the external air.

Generator 1 and water cooled absorber 4 form an interlinked system which is filled with a suitable working substance solution (coolant and solvent, e.g. $CH_3)H/H_2O$-LiBr), most of the working substance solution being located in absorber 4. Generator 1 is directly heated by a burner, e.g. an oil or gas burner. It has a small volume heat exchanger, through which the working substance solution flows from bottom to top, so that the evaporation of the light volatile component or components in the coolant starts after only a very short time, e.g. 30 seconds. The linked connection of the heat exchanger of generator 1 to the water cooled absorber 4 takes place by a low connecting line 10 for the inflowing rich solution and a high connecting line 11 for the outflowing weak solution. The vapor bubble formation in the vertical boiling tubes of the heat exchanger of the generator 1, which is consequently construted as a thermosiphon, starts up a natural circulation of the coolant-rich solution between the generator 1 and the water cooled absorber 4, which ensures an adequately high heat and substance exchange in the generator 1. The coolant vapor is condensed in the higher condenser 3 and is kept in stock for subsequent evaporation, is passed in throttled form into the evaporator 5. The upper end of the heat exchanger of generator 1 is for this purpose connected by a connecting line 12 to the vapor chamber of condenser 3. The condensation heat released during the condensation of the coolant vapor is returned as useful heat to a heating water flow flowing back from a heating system and which is to be heated, and which subsequently passes through the waste gas cooler 2. The water gas cooler 2 arranged in the upper part of the generator 1, uses the remaining waste gas heat not transferred to the heat exchanger of the generator 1 virtually up to the useful temperature.

The liquefied coolant is initially stored in the lower part of the condenser 3, in a coolant accumulator or directly in the evaporator 5, for subsequent evaporation.

Condenser 3 is connected to the heat exchanger of the evaporator 5 by a condensate line 13, with an incorporated stop valve 14. The vapor chamber of the heat exchanger of evaporator 5 is connected by a connecting line 15 with incorporated one-way valve 16 to a high vapor connection of absorber 4. The one-way valve 16 can be a check valve, which solely permits vapor transfer from the evaporator 5 to the water cooled absrober 4 and also prevents the overflow of working substnace solution from the water cooled absorber 4 into the evaporator 5. Finally, the water cooled absorber 4 is connected to the lower part of the water cooled condenser 3 by a connecting line 17, so that in the case of direct or permanent heating operation, i.e. with a completely filled condensate accumulator or evaporator, condensate can pass directly from the water cooled condenser 3 to the water cooled absorber 4.

The return water flowingback from a heating system can be delivered with the conventional heating water pump 20 via a line 21 to the heat exchanger of the water cooled condenser 3 and via a line 22 to the heat exchanger of the water cooled absorber 4. In generator and permanent heating operation, the heating water passing out of the water cooled condenser 3 passes via a line 23 to the waste gas cooler 2 and a line 24 to a reversing valve 25 and, in the position shown in FIG. 1, into the heating water forward flow line 26. In the following absorber operation (FIG. 2), after reversing the reversing or changeover valve 25, the heating water now passing out of absorber 4 passes directly via a line 27 to valve 25 and, in the position shown in FIG. 2, into the forward flow line 26.

Figure 3:
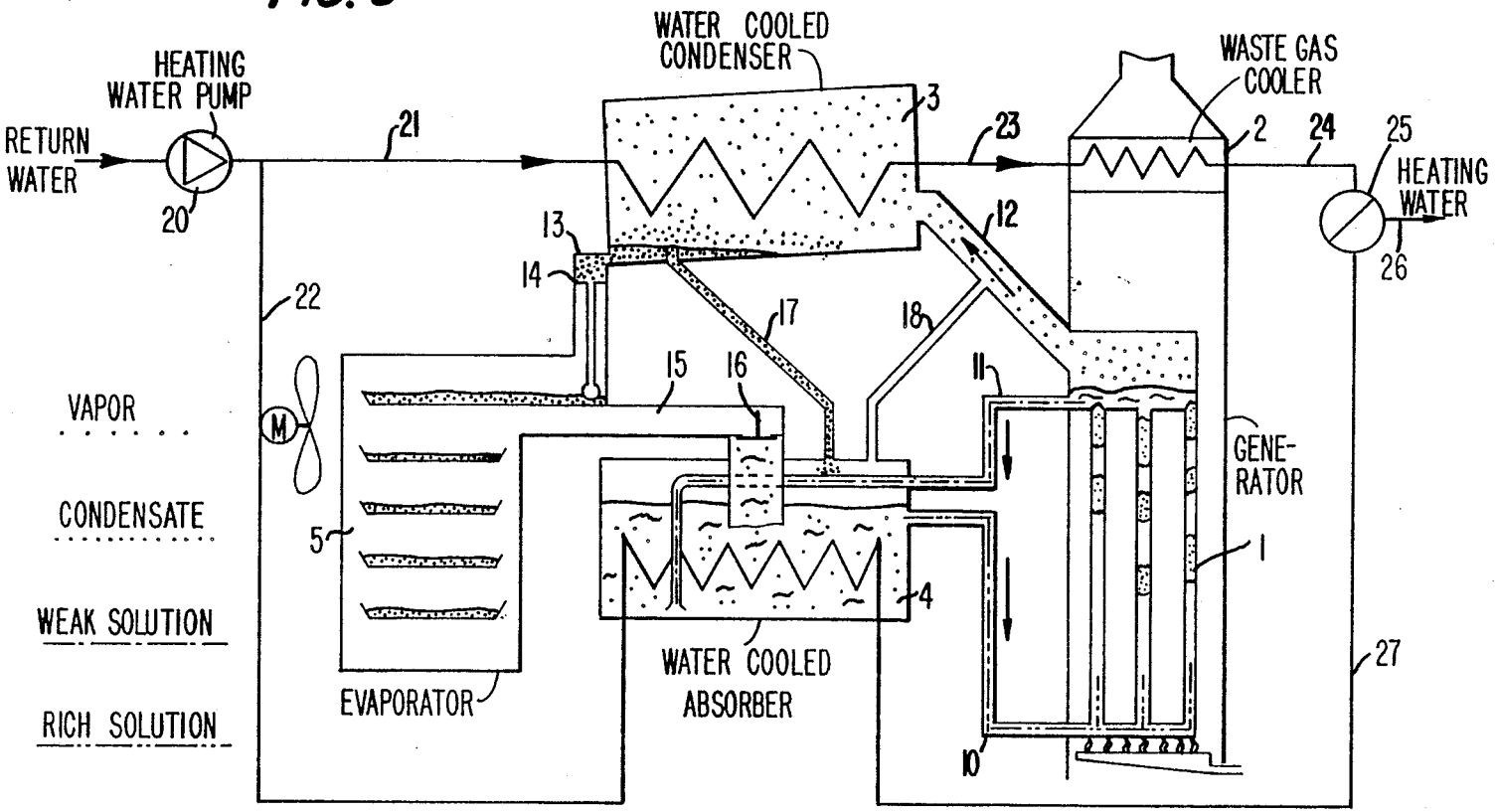
FIG. 3 is the schematic circuit diagram according to FIG. 1, in the permanent heating operation or boiler operation phase.

If in the generator operation shown in FIG. 1, the limit of possible degassing of the coolant component or components is reached, the one-way valve 14 in line 13 between the water cooled condenser 3 and the evaporator 5, which can be constructed as a float valve, in the case of maximum permitted filling of the water cooled the coolant accumulator of condenser 3 or the evaporator, that condensate still produced in the water cooled condenser 3 flows back directly into the water cooled absorber 4. The working substance solution then serves as a purely heat carrier fluid and permanent heating operation (boiler operation), as shown in FIG. 3, with the maximum rated heating power is possible. The generator absorption heat pump heating installation, which could also be called a boiler, with a periodically operating absorber part, consequently constitutes a monovalent heating installation which covers the maximum heating heat requirement of the building without any further heating means.

The generator operation takes place i.e. the burner is switched on, if the rising forward or return temperature of the heating system indicates that there is no further heat requirement. This can take place by a simple hot water thermostat or by a heat sensor in the solution. In the case of complete filling of the condensate accumulator (evaporator) and further heat requirement, generator operation automatically passes into permanent heating operation according to FIG. 3, and this can be continued for a random period. If after switching off the burner further heat requirement is indicated, then by reversing the changeover valve 25, absorber operation is automatically initiated, because now through heat extraction by the heating water the solution temperature drops and consequently the solution becomes absorptive and consequently the absorption process can start.

Figure 2:
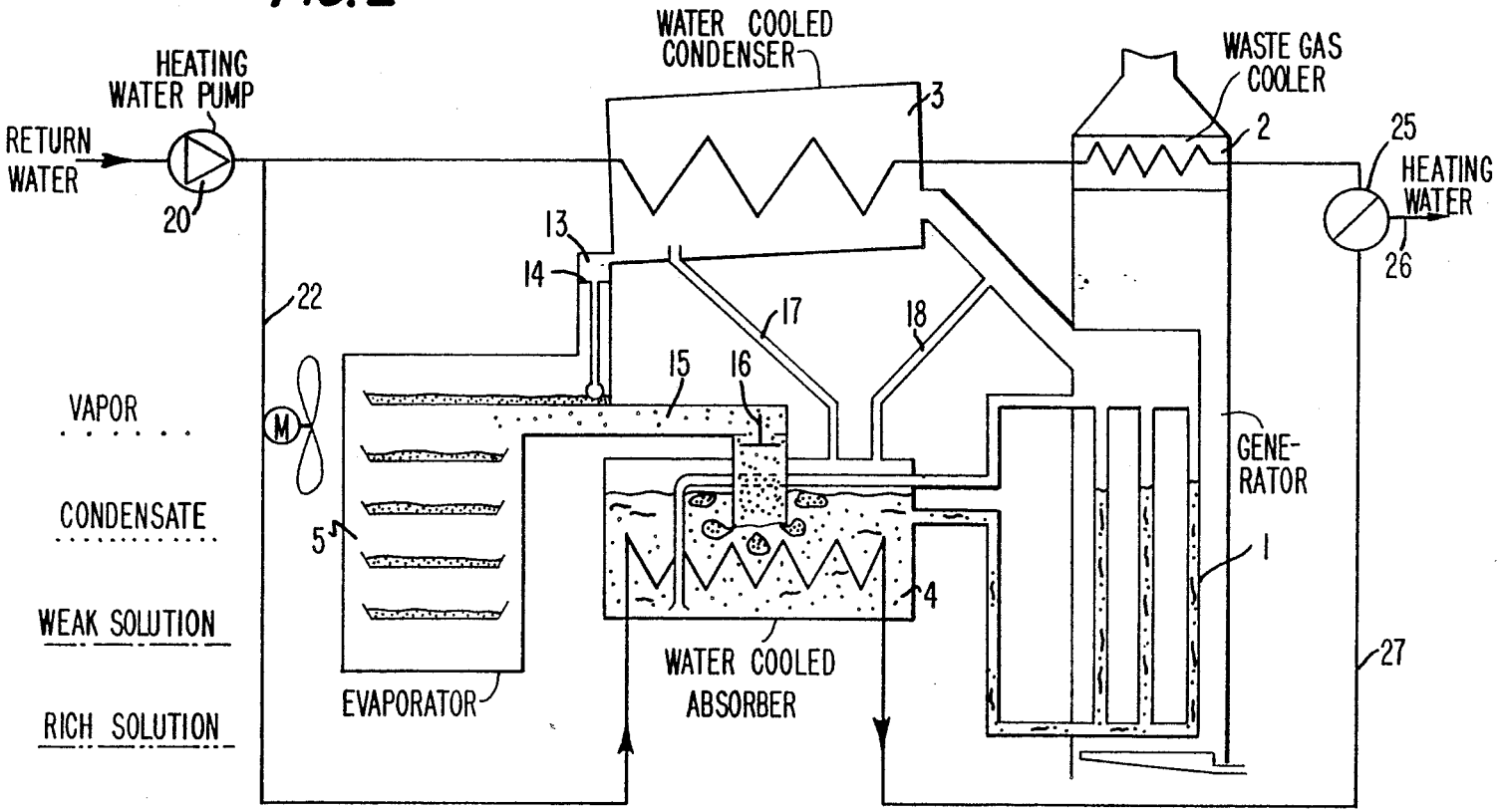
FIG. 2 is the schematic circuit diagram according to FIG. 1, but in the absorber operation phase.

Whereas during generator and permanent heating operations there is a high pressure level of the working substance solution, absorber operation, as shown in FIG. 2, and into which the installation can pass after switching off the burner, it is characterized by low pressure. By reversing the changeover valve 25, the heating water flow from condenser 3 and waste gas cooler 2 is diverted to the heat exchanger of absorber 4 and consequently the vapor pressure of the solution is reduced by heat abstraction and the resulting cooling under the vapour pressure of the coolant (mixture) in the evaporator, so that evaporation thereof is possible at low temperatures. If the temperature of the boiling coolant in the evaporator 5 reaches the level of the low temperature heat source, e.g. the external air, so that is can supply low temperature heat to the evaporator 5, a device, e.g. a fan, is put into operation for the transfer of the low temperature heat carrier, i.e. the air. The fan can be switched on by a temperature difference sensor. The cold vapor from the evaporator 5 passes through the one-way valve 16 in the form of a check valve in connection line 15 to the water cooled absorber 4 and is absorbed therein above the useful temperature level, cf. FIG. 2, External air, spent air, ground water, running water, absorber top, etc. can be used as low temperature heat sources. The absorption heat formed during absorption is supplied to the heating system via the heat exchanger of absorber 4 through which the heating water now flows. Numerous measures can be provided in the water cooled absorber 4 for bringing about an optimum substance heat exchange, and to utilize the solvent until its initial concentration is reached.

The minimum necessary temperature rise in the absorber or heat pump operations can be set within the limits given by the substance system by the coolant concentration of the fed in solution. Moreover, the storage of a specific coolant quantity can bring about an evaporation with sliding absorber temperature, i.e. dependent on the necessary temperature rise. Thus, for every difference between the external temperature and the heating water temperature, a maximum utilization of the degassing scope of the working substance system and consequently a maximum low temperature heat utilization are possible.

It is also conceivable to use coolant mixtures (e.g. water and methanol), whereby the lower boiling component remains partly stored at low external temperatures, e.g. 0° C., whereas at higher external temperatures, e.g. 12° C., its advantageous thermodynamic properties come into effect.

If evaporator-absorber operation no longer appears to be appropriate due to low external temperatures (e.g. when using the external air as the low temperature heat source) permanent heating operation of the heating installation with rated calorific power according to FIG. 3 is possible, if the condensate produced during generation is returned directly to the water cooled absorber 4. The working substance solution, which serves as the heat transfer fluid in the operating phase, supplies the heating heat to the heating water via the water cooled condenser 3.

This periodically operating absorption heat pump consequently constitutes a full heating installation, which can supply both the basic load and the peak load of the heating heat requirement.

If the heat requirement drops again during permanent heating operation indicated by an adequate heating water temperature for the exceeding of a given heating water temperature, the thermostat puts the burner out of operation again. This is followed by a switching over of a heating water flow by the changeover valve 35 to the heat exchanger of the water cooled absorber 4 when a further heat requirement is indicated by dropping below the predetermined heating water temperature. Through increasing cooling of the working substrate solution, the latter now becomes absorptive, so that automatically there is evaporation at low temperature and absorption above the useful temperature level. The absorption phase can be continued until the temperature rise of the heating water is no longer sufficient and the dropping heating water temperature to below a predetermined low level starts off the burner again.

The calorific power of the installation is continuously variable as a function of the heat requirement consequently via the ratio of the burner running time (generator operating time) to the absorber operating time. Thus, unlike in continuous installations, there are particularly good thermal conditions in the partial load operation, because with rising external temperatures the possible absorption of coolant vapor in the working substance solution constantly increases.

As a result of the simple construction of the periodically operating absorption heat pump, its monovalent operation and its simple control, manufacture from few equipments is less complicated. Since apart from conventional components, the installation contains no moving parts, a long service life and correspondingly low maintainance expenditure are to be expected. Maintainance and installation can be carried out by the heating engineer alone, if the installation is hermetically sealed in the manufacturing factory.

Advantageous embodiments of individual equipments will now be described.

The core of the directly heated generator 1 is a vertically positioned, transversely ribbed bundle of ribbed tubes, whose lower part terminates in a feed distributor, which is located in the immediate vicinity of the heating mechanism (gas burner, oil burner, etc.). At the upper end the tubes issue into a vapor-liquid separator, whose function is to separate the boiled off solution from the coolant to be drawn off. A special asymmetrical arrangement of the deflectors between the ribbed tubes ensures that hot combustible gases are supplied uniformly right up to the top end of the ribbed tubes, so that the waste gas leaves the generator in an already largely cooled form. The top of the generator 1 is additionally constructed as a waste gas cooler 2, so that it is possible to utilize the fuel up to the calorific value. The vertical arrangement of the tubes with a horizontal guidance of the combustible gases along the ribs, together with the solution movement in the tubes brought about by the vapor bubbles, ensures a highly efficient heat and substance exchange. In addition, the tubes are internally roughened in order to aid vapor bubble formation.

The water cooled absorber 4 is constructed as a bubble absorber, i.e. the coolant vapor is introduced in such a way into the absorptive solution, that a good thorough mixing there is achieved and concentration differences in said equipment remain small during the absorption phase. Further measures for improving the heat and substance exchange are the use of an e.g. milled-profiled tubular heat exchanger, in order to achieve a surface enlargement, weight saving and the production of turbulence in the solution, the incorporation of a circulating device, with the aid of which sprayed on solution is collected and stored at the bottom of the container, so that a natural circulation of the solution is ensured in absorber operation.

The connecting line between the generator 1 and the water cooled absorber 4, in which the hot, low coolant solution flows from the generator to the absorber appropriately terminates in diffusor-like manner at the opposite end (at the bottom opposite the side of the absorber at which the feed line 10 for the high coolant, cooler solution starts). This arrangement prevents a thorough mixing of the solution in the generator phase, so that throughout the generator period there is a substantially constant degassing scope at the generator 1. A further advantage is that only a small amount of solvent has to be heated for a brief operation of the generator 1.

A third connecting line 18 between the water cooled absorber 4 and the generator 1, which interconnects the vapour chambers of said two equipments, ensures that the solution in the generator does not drop due to the higher vapour pressure during degassing (pressure compensating line).

The water cooled condenser 3 is constructed as a spiral tube condenser, a drainage channel for the condensate being provided on the bottom of the cylindrical jacket. The apparatus is installed in such a way that condensate outflow by gravity is possible.

The external air evaporator 5 can be a flooded bundle of ribbed tubes (coolant in the tubes), in which a special distributor means ensures that the condensate produced is uniformly applied over all the tubes. This is achieved by a distributor channel with overflow port provided laterally on each row of ribbed tubes and which doses the coolant quantity per row. The container wall on which coverage the vapor outlets of the tubes, is also sloped with respect to the vertical, so that during evaporation oversprayed coolant of the upper rows flows again to the lower rows. The evaporator can be operated as a dry evaporator, if the feed line between a condensate of the water cooled condenser 3 and the evaporator 5 is equipped with a distributor means for the ribbed tubes and an automatic regulating member for dosing the necessary coolant quantity. The connecting line 15 between the evaporator 5 and water cooled absorber 4 is equipped with an automatically operating check valve 16, whose function is to prevent condensation of coolant vapor in the water cooled evaporator 4 during generator operation and also to prevent an overflow of solution into the water cooled evaporator for. The vapor line 12 between the generator 1 and the water cooled condenser 3 is bent at a number of points, to prevent overspraying of solution into water cooled condenser 3 in the case of violent generator operation.

We claim:

1. Process for an operation of a generator absorption heat pump heating installation for wherein heating energy to the supplied to a heating liquid to be heated flowing back from the heating system can be supplied both by high temperature heat taken from a directly heated generator means and from low temperature heat absorbed by an absorption heat pump means, the method comprising the steps of: operating the absorption heat pump means with a periodic change of operating phases including a generation phase with condensation and an evaporation phase with absorption at different pressure levels, supplying, in the generation phase, high temperature heat through the generator means to a working substance solution circuit and supplying useful heat during the condensation phase of resulting vapor of a condenser to the heating liquid, supplying, during the absorption phase, the high temperature heat to the coolant in an evaporator means and as useful heat in an absorber means to the heating liquid, and automatically alternately switching both high and low temperature heat supply on when a heating liquid return or supply temperature drops below a predetermined lower temperature limit and off when the hot liquid return or supply temperature rises above a predetermined upper temperature limit.

2. Process according to claim 1, further comprising the step of diverting substantially a maximum calorific power of the heat pump heating installation at low external temperatures by a high heat temperature heat supply to the generator means and from the generator means to a working substance solution circuit means of the absorption heat pump means, and the condensate produced in the condenser means following a complete filling of a coolant accumulator means is returned to the absorber means in the absorption heat pump means, the using the working substance solution as a heat carrier between the generator means and the condenser means through which the heating liquid flows.

3. Process according to one of claims 1 or 2, further comprising the steps of maintaining a minimum running time for obtaining a very high heat absorption on the evaporator means and performance figure rise of the generator means and absorber means operation of the heat pump heating installation.

4. Monovalent alternative generator absorption heat pump installation up to a calorific capacity of approximately 20 kW, the heat pump heating installation comprising heat pump means including an evaporator means heatable by external heat having a heat exchanger means through which a coolant flows, an absorber means connected on a cold vapor side to the evaporator means and including a heat exchanger means through which heating liquid of the heating system flows, a condenser means connected on a coolant side to the evaporator means and to the absorber means and including a heat exchanger means through which the heating liquid flows, a generator means directly heatable by primary energy including a heat exchanger means constructed as a thermosiphon connected to the absorber means at a low point and a high point of the absorber means so as to permit natural circulation of a working substance solution from the absorber means through the generator means and back to the absorber means and to a working substance accumulator means of the condenser means, stop valve means respectively provided in connecting lines between the evaporator means and the absorber means and between the condenser means and the evaporator means, said stop valve means between the evaporator means and the absorber means includes a one-way valve means for allowing a vapor flow only to the absorber means, said stop valve means between the condenser means and the evaporator means includes a one-way valve means for only allowing a liquid flow to the evaporator means and closing when the evaporator means is completely filled with liquid so as to permit a flow back into the absorber means by a liquid line means, whereby heating liquid can be passed through the heat exchanger means of the condenser means during high temperature heat supply and through the heat exchange means of the absorber means during the low temperature heat supply, and wherein a switching over of the heating liquid flow can be alternately automatically performed by a change-over valve means when the heating liquid return or supply temperature drops below a predetermined preset temperature.

5. Installation according to claim 4, wherein the generator means includes a waste gas cooler means connected downstream of the condenser means on a heating liquid side.

6. Installation according to one of claims 4 or 5, wherein the generator means and the absorber means are separated from one another, and wherein the absorber means is constructed as a working substance solution accumulator.

7. Installation according to claim 6, wherein vapor chamber means of the absorber means and the generator means are connected by a vapor pressure compensating line means.

8. Installation according to claim 7, wherein the high point of the absorber means includes a high outlet means for a rich solution and low point of the absorber means includes low outlet means for a weak solution, said high outlet means and low outlet means are arranged in such a way that a natural concentration stratification during a discharge of the solution can be utilized with a minimum reabsorption.

9. Installation according to claim 8, wherein the absorber means includes means which, during absorption, returns to a lower part of the absorber means sprayed on solution and brings about a forces circulation for preventing stratification of a concentration of the solution.

10. Installation according to claim 9, wherein at least one of the condenser means is provided with a coolant accumulator and the evaporator means is constructed as a coolant accumulator.

11. Installation according to claim 10, wherein the stop valve means between the condenser means and the evaporator means closes when maximum permitted filling does not permit a vapor flow from the evaporator means to the condenser means so as to bring about an entry of liquid into the absorber means through the liquid line means between the condenser means and the absorber means.

12. Installation according to claim 11, wherein said stop valve means includes a one-way float valve means.

13. Installation according to claim 12, wherein the working substance solution includes a plurality of coolant components having lower boiling fractions which remain in the coolant accumulator as the low temperature heat drops.

14. Installation according to claim 13, wherein a heat exchanger means is interposed between the absorber means and the generator means.

15. Process according to claim 1, wherein the heating pump installation is for at least one of space heating and water heating.

16. Installation according to one of claims 4 or 5, wherein vapor chamber means of the absorber means and the generator means are connected by a vapor pressure compensating line means.

17. Installation according to one of claims 4 or 5, wherein the hight point of the absorber means includes a high outlet line means for a rich solution and the low point of the absorber means includes low outlet means for a weak solution, said high outlet means and said low outlet means are arranged in such a manner that a natural concentration stratification during a discharge of the solution can be utilized with a minimum reabsorption.

18. Installation according to claim 17, wherein the absorber means includes means which, during absorption, returns to a lower part of the absorber sprayed on solution and brings about a forced circulation for preventing stratification of a concentration of solution.

19. Installation according to one of claims 4 or 5, wherein the condenser means is provided with a coolant accumulator means.

20. Installation according to one of claims 4 or 5, wherein the evaporator means is constructed as a coolant accumulator means.

21. Installation according to one of claims 4 or 5, wherein the stop valve means between the condenser means and the evaporator means closes when maximum permitted filling does not permit a vapor flow from the evaporator means to the condenser means so as to bring about an entry of liquid into the absorber means through the liquid line means between the condenser means and the absorber means.

22. Installation according to claim 21, wherein said stop valve means includes a one-way float valve means.

23. Installation according to one of claims 4 or 5, wherein the working substance solution of the heat pump heating installation includes a plurality of coolant components having lower boiling fractions which remain in a coolant accumulator as the low temperature heat drops.

24. Installation according to one of claims 4 or 5, wherein a heat exchanger means is interposed between the absorber means and the generator means.

* * * * *